US007167659B2

(12) United States Patent
Fujita et al.

(10) Patent No.: US 7,167,659 B2
(45) Date of Patent: Jan. 23, 2007

(54) IMAGE-FORMING APPARATUS WITH INERTIAL MEANS SELECTIVELY CONNECTED TO FIXING DRIVE

(75) Inventors: Takashi Fujita, Chiba (JP); Akihiro Shimizu, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/483,724

(22) Filed: Jul. 11, 2006

(65) Prior Publication Data

US 2006/0251434 A1 Nov. 9, 2006

Related U.S. Application Data

(62) Division of application No. 10/938,720, filed on Sep. 13, 2004, now Pat. No. 7,127,186.

(30) Foreign Application Priority Data

Sep. 24, 2003 (JP) ..... 2003-331932

(51) Int. Cl.
*G03G 15/20* (2006.01)

(52) U.S. Cl. ..... 399/67

(58) Field of Classification Search ..... 399/45
See application file for complete search history.

(56) References Cited

U.S. PATENT DOCUMENTS 5,956,543 A 9/1999 Aslam et al. ..... 399/45
6,272,307 B1 8/2001 Ishizuka et al. ..... 399/325
6,409,043 B1 6/2002 Fujita et al. ..... 221/10.03
6,487,381 B1 11/2002 Ishizuka et al. ..... 399/67
6,608,991 B1 8/2003 Takada ..... 399/45
6,691,399 B1 2/2004 Hayashi et al. ..... 29/605
2003/0002161 A1 1/2003 Shimizu et al. ..... 399/44

FOREIGN PATENT DOCUMENTS

JP 6-318009 11/1994
JP 2000-19798 1/2000

OTHER PUBLICATIONS

Machine translation of JP 2000-19798.

*Primary Examiner*—David M. Gray
*Assistant Examiner*—Ruth N. LaBombard
(74) *Attorney, Agent, or Firm*—Fitzpatrick, Cella, Harper & Scinto

(57) ABSTRACT

An image forming apparatus has an image forming unit together with a fixing unit which uses two rotating members to form a nip in which the recording material with an unfixed image is fed. A driving unit drives the rotatable fixing members and a flywheel is used for increasing an inertial force of that drive, there also being a connecting device which selectively connects the flywheel with the driving unit together with a switching device that switches operation of that connecting device in accordance with the type of recording material being used or the density of the image to be printed.

3 Claims, 18 Drawing Sheets

WITHOUT FLYWHEEL

WITH FLYWHEEL
(THICKEST PAPER)

FIG. 12

| IMAGE DENSITY | | | | | |
|---|---|---|---|---|---|
| 200～400% | FW-on=0 | FW-on=1 | FW-on=1 | FW-on=1 | FW-on=0 |
| 100～200% | FW-on=0 | FW-on=0 | FW-on=1 | FW-on=1 | FW-on=0 |
| ～100% | FW-on=0 | FW-on=0 | FW-on=0 | FW-on=1 | FW-on=0 |
| | THIN PAPER | NORMAL PAPER | CARDBOARD | HEAVY CARDBOARD | OHP |

PAPER KIND

FLYWHEEL SETTING TABLE

| | | | | | |
|---|---|---|---|---|---|
| PRE-REVOLUTION | V=1/4 | V=1/4 | V=1/4 | V=1/4 | V=1/4 |
| POST-REVOLUTION | V=1/4 | V=1/4 | V=1/4 | V=1/4 | V=1/4 |

| | | | | | |
|---|---|---|---|---|---|
| DURING NORMAL PAPER | V=1 | V=1 | V=2/3 | V=1/2 | V=1/3 |
| | THIN PAPER | NORMAL PAPER | CARDBOARD | HEAVY CARDBOARD | OHP |

PAPER KIND

FIXING SPEED SETTING TABLE

IMAGE-FORMING APPARATUS WITH INERTIAL MEANS SELECTIVELY CONNECTED TO FIXING DRIVE

This application is a divisional of U.S. patent application Ser. No. 10/938,720, filed Sep. 13, 2004 now U.S. Pat. No. 7,127,186.

BACKGROUND OF THE INVENTION

1. Field of the Invention

The present invention relates to an image-forming apparatus using an electrophotographic system or an electrostatic recording process, and in particular relates to an image-forming apparatus such as a copying machine, a printer, and a facsimile machine, or to a multi-function machine having a plurality of these functions.

2. Description of the Related Art

An image-forming apparatus, such as a copying machine, a printer, and a facsimile machine, have widely used a method in which an unfixed toner image is formed on a recording material (a paper member such as transfer paper, photographic paper, dielectric-coated paper, and printing paper) formed thereon by a transfer system (indirect system) or a direct system with an appropriate image-forming mechanism, such as an electrophotographic system, an electrostatic recording system, and a magnetic recording system; then, the unfixed toner image is thermally fixed.

Recently, in such an image-forming apparatus, various kinds of recording material has been required in addition to so-called copy paper. As an example, there is cardboard: in order to fix an image on cardboard you require large thermal capacity, and a pressurizing force applied to a fixing roller is an important condition as well as thermal capacity applied to the recording material, so that the pressurizing force also needs to be increased.

However, as a negative effect of the increased pressure, the drive load violently increases at the moment when the leading edge of the cardboard is introduced into the nip between the fixing rollers. As a result, rotational variations of the fixing rollers are liable to be produced because of the rotational variation of a motor itself and the accumulation of micro-deflections of components of a drive system produced if the drive transfer path to the fixing rollers. FIG. 18 is a graph showing rotational variations of a fixing roller 4*a* plotting time t in abscissa and peripheral speed V of the fixing roller 4*a* in ordinate, and symbol A denotes the rotational variations when the cardboard is introduced into the nip of the fixing roller 4*a*. As shown in the drawing, the peripheral speed is reduced by the violently increased load. When the fixing roller 4*a* rides out the leading edge, the load is decreased; however, the peripheral speed is increased higher than a steady speed by the reaction of the drive system, which is deflected when the load is increased.

Then, the rotational variations are attenuated so that the steady speed is returned: at this time, the following problems arise.

Japanese Patent Laid-Open No. 6-318009 discloses that in order to prevent the speed of a fuser from varying when paper runs into the fuser, the drive system of the fuser may be provided with a flywheel.

Japanese Patent Laid-Open No. 2000-19798 discloses a magnetic clutch is provided for selectively connecting between a drive system of a fuser and a flywheel, so that when a recording material is jammed, the connection between the drive system of the fuser and the flywheel is released so as to reduce a period of time required for stopping the fuser.

A full-color image-forming apparatus is provided with a device for applying silicone oil as release agent on a fixing roller in order to improve releasability of a transfer agent from the fixing means and to prevent jamming.

In such a device, since it is driven by the same drive source as that of the fixing roller 4*a*, when the fixing roller varies in rotation, an oil applying roller 40 also varies in rotation. At this time, oil coating unevenness may be produced, resulting in uneven brightness and streaks of images. An example of such a device will be described below.

Referring to FIG. 15, the fixing roller 4*a* and the pressure roller 4*b*, which are for fusing the recording material in the nip by pressurizing and conveying it, are made of an aluminum core having elastic silicone rubber fixed on the surface; inside each core, halogen heaters 45*a* and 45*b* are arranged as heating sources; and thermistors (not shown) come in contact with on the respective surfaces of the silicone rubber for detecting temperatures of the surfaces. The controller in the body controls the electric power supply to the halogen heaters by comparing the temperature of each thermistors with a pre-established temperature so as to turn on the halogen heaters 45*a* and 45*b* via an AC driver whenever the temperature is lower than the established one while turning off electric power supply whenever the temperature is higher than the established one, thereby controlling the temperatures of the fixing roller 4*a* and the pressure roller 4*b* to maintain them constant.

In the device shown in the drawing, part of a first pumping roller 43 is dipped in release oil O contained in an oil pan 65 while a second pumping roller 42 rotates adjoining the first pumping roller 43. A third pumping roller 41 is adjacent to the second pumping roller 42. The second pumping roller 42 is rotated by a drive source so as to transmit the driving force to a coating roller 40 for applying the release oil O via the third pumping roller 41 and the first pumping roller 43. The second pumping roller 42 also serves as the rotational center for urging the coating roller 40 to the fixing roller 4*a* by a pressure spring 38. In such a manner, the coating roller 40 applies the release oil O sequentially pumped by each of the pumping rollers on the surface of the fixing roller 4*a*. A metering blade 44 for restricting the release agent made of an elastic body, such as fluoride rubber, and urged by a spring 49 so as to constantly maintain a predetermined pressure is arranged in contact with the coating roller 40, thereby defining the amount of the oil on the coating roller 40 at a predetermined value. The oil on the coating roller 40 restrictedly applied thereon is transferred to the fixing roller 4*a*. The residual oil on the coating roller 40 is removed outside the oil pan 65 by a cleaning blade 39 together with toner and paper dust stuck on the fixing roller 4*a*. This residual oil is recovered to an oil tank (not shown), which will be described later, via a filter for recycling.

Details will be described with reference to FIGS. 15 to 17. As described above, the oil transferred to the pumping roller 41 from the pumping roller 43 and the oil pan 65 is restricted by the metering blade 44 on the coating roller 40. The restricted oil forms a minute oil sump D between the edge of the metering blade 44 and the coating roller 40 along the entire longitudinal region during the steady rotation. The oil sump D is formed to keep the balance between the amount of oil scraping through the metering blade 44, a surface tension, an oil viscosity, and the gravity. However, if vibration, such as rotational variations mentioned above, is applied, the oil sump D gets out of balance so that the oil pours out. The poured out oil is transferred on the recording material in a streak pattern via the fixing roller 4*a,* and the length of the streak from the leading edge of the recording material is equivalent to distance L between the metering blade 44 and the nip of the fixing roller 4*a* (FIG. 16). The oil streak is not noticeable in images if the amount is small; however, if the amount is increased, the oil streak affects images as uneven brightness and color shading, and this effect deteriorates in proportion to the intensity of the vibration, such as the rotational variations.

However, when the flywheel is provided in the driving system of the fuser in order to suppress the rotational variations due to the recording material running into the nip of the fuser, since the flywheel must be rotated even for fixing images on thin paper having small rotational variation when running into the fuser, vibration due to the decentration of the flywheel and dispersion of the weight may be generated, deteriorating banding.

In a small sized device with a small distance between the transfer and the fixing, the vibration also may especially affect the vicinity of an engine through a frame. Although the vibration is reduced if the flywheel and the drive transfer system are manufactured with high precision, this device has a defect of high cost including assembling requiring adjustment. When the fuser is started in a state that the flywheel is connected thereto, since the inertial load due to the flywheel is large, a motor larger than necessary must be used especially in using a stepping motor as a drive source.

SUMMARY OF THE INVENTION

It is an object of the present invention to provide an image-forming apparatus capable of suppressing speed variations of fixing means when a recording material runs into a nip as well as suppressing reduction in life of driving means.

It is another object of the present invention to provide an image-forming apparatus capable of preventing incorrect detection of the driving means as being in an abnormal rotational state when the driving means is connected to the inertial means.

In a first aspect of the present invention, an image-forming apparatus includes fixing means for fixing an image formed on a recording material at a nip; driving means for driving the fixing means; inertial means for increasing an inertial force; connecting means for selectively connecting between the driving means and the inertial means; and switching means for switching an operation of the connecting means in accordance with a kind of the recording material.

In a second aspect of the present invention, an image-forming apparatus includes fixing means for fixing an image formed on a recording material at a nip; driving means for driving the fixing means; inertial means for increasing an inertial force; connecting means for selectively connecting between the driving means and the inertial means; detecting means for detecting abnormal rotation of the driving means; and stopping means for stopping the driving means when the abnormal rotation is detected, wherein when the connecting means is operated, the stopping means cancels a signal from the detecting means.

In a third aspect of the present invention, an image-forming apparatus includes fixing means for fixing an image formed on a recording material at a nip; driving means for driving the fixing means; inertial means for increasing an inertial force; connecting means for selectively connecting between the driving means and the inertial means; and switching means for switching an operation of the connecting means in accordance with a density of an image to be formed on the recording material.

Further objects, features and advantages of the present invention will become apparent from the following description of the preferred embodiments with reference to the attached drawings.

BRIEF DESCRIPTION OF THE DRAWINGS

FIG. 12 includes setting tables for the flywheel and a fixing speed.

DESCRIPTION OF THE PREFERRED EMBODIMENTS

The present invention will be described more specifically by the following embodiments. Embodiments below are examples of the best mode for carrying out the invention; however, the present invention is not limited to these embodiments.

[First Embodiment]

Figure 2:
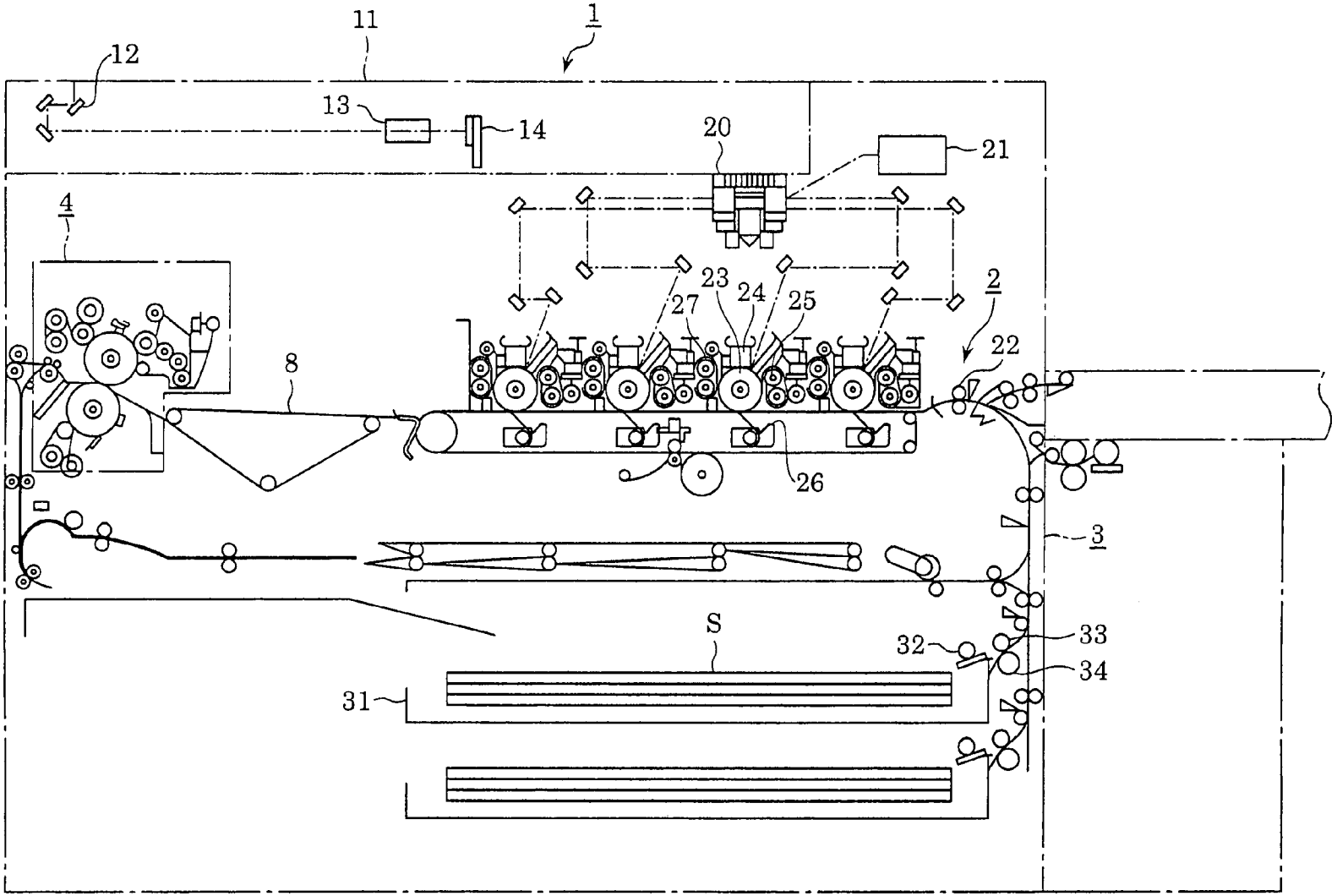
FIG. 2 is a front view of an entire apparatus according to the present invention.

An embodiment of an electrophotographic copying machine using a recording material conveying device with the above-mentioned unit used therefor will be described below. FIG. 2 is a schematic sectional view of the copying machine according to the first embodiment.

First, referring to FIG. 2, a schematic structure of the copying machine will be described. In the copying machine, image information read by a reader unit 1 having a scanning optical system is photo-electrically converted and transmitted to an image-forming unit 2, so that in the image-forming unit 2, an image is formed on a recording material S supplied by a feeding unit 3. The recording material S having the image formed thereon is conveyed to a fuser 4 in which a transferred image is fixed by heat and pressure applied thereto. Since a series of electrophotographic processes is known, detailed description is omitted.

(Reader Unit)

A document placed on a document table glass 11 is irradiated to light by a scanning optical system including a light source and a reflection mirror group. The reflected light is focused on a CCD (charge coupled device) 14 via a reducing lens 13. The image information is transferred to a memory after photo-electrical conversion and A/D (analog to digital) conversion. The maximum document size is LTR (letter size) or A3 (Japanese Industrial Standard).

(Feeding Unit)

In a lower portion of the copying machine, a paper cassette 31 having recording materials S accommodated therein is detachably mounted. On standby, a pick-up roller 32 is spaced from the surface of the recording material S by a turned-on solenoid (not shown) connected to the pick-up roller 32. When the recording material is fed, the pick-up roller 32 is brought into contact on the surface of the recording material by the turned-off solenoid. Then, the top recording material is fed by the rotating pick-up roller 32. The pick-up roller 32 is driven by a conveying roller 33 through a timing belt.

The picked-up recording material is introduced into the nip between the conveying roller 33 and a retard roller 34. The conveying roller 33 is rotated in a conveying direction of the recording material while the retard roller 34 is rotated in a direction opposite to the conveying direction via a torque limiter (not shown). Since only the leading edge of a first sheet exists in the nip, the torque limiter is overcome by a frictional force between the recording material and the conveying roller 33, so that the retard roller 34 is rotated in the conveying direction. Then, when recording materials overlapping one another reach the nip, a frictional force between first and second recording materials is overcome by the torque limiter, so that the retard roller 34 is rotated in the direction opposite to the conveying direction. Thus, only the top sheet is separated and conveyed. Even if a plurality of the recording materials S are temporarily picked up, only the top sheet is separated to proceed in the same way.

By such feeding operation, placed recording materials can be fed one by one.

(Conveying Unit)

The recording material fed by the feeding unit 3 is once stopped at its leading edge by a resist roller 22, and then is again fed in conformity with images formed by the image-forming unit 2, so that the images are transferred in a transfer unit. The resist roller 22 is rotated by a stepping motor (not shown), and the rotation is controlled by a controller in the apparatus body.

(Image-Forming Unit)

A laser beam having image information read by the reader unit 1 is emitted from a laser beam source 21. The laser beam is scanned in a generating direction of a photosensitive drum 23 by the rotation of a polygon mirror 20 so as to form latent images on the drum surface electrically charged by a charger 24 in advance. The latent images are developed by a developer unit 25 arranged around the photosensitive drum 23, and then, toner images are transferred on the recording material S by a transfer charger 26. The residual toner on the drum surface after the image transfer is removed by a cleaner 27.

In this apparatus, the same image-forming units are sequentially arranged for cyan, magenta, yellow, and black, and read images are separated into the respective colors at each unit so as to form color images by multiple transfer.

(Fuser)

The recording material S having toner images transferred thereon in the image-forming unit 2 is transported on conveyor 8 to the fuser 4, so that the toner images are fixed on the recording material S by the heat and pressure applied thereto during passage between a fixing roller 4*a* and a pressure roller 4*b*.

Figure 1:
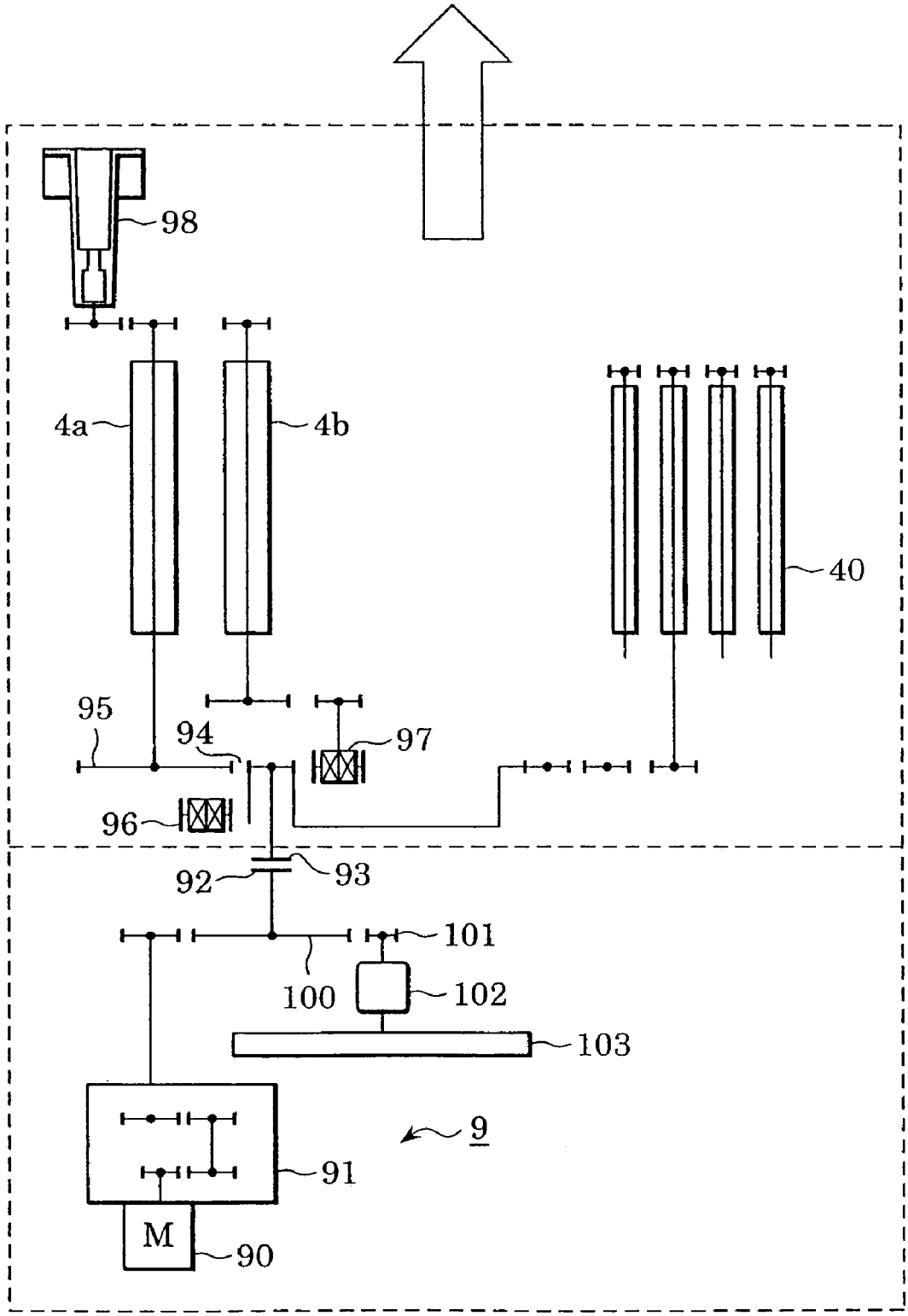
FIG. 1 is a drive drawing of a fuser according to the present invention.

Details of the fuser will be described with reference to FIG. 1. FIG. 1 is a sectional view of the fuser according to the first embodiment of the present invention.

Referring to FIG. 1, the fixing roller 4*a* and the pressure roller 4*b*, which are for fixing the recording material in the nip by pressurizing and conveying it, are made of an aluminum core having elastic silicone rubber fixed on the surface; inside each core, halogen heaters (not shown) are arranged as heating sources; and thermistors (not shown) come in contact with on the respective surfaces of the silicone rubber for detecting temperatures of the surfaces. The controller in the apparatus body controls the electric power supply to the halogen heaters by comparing the temperature of each thermistors with a pre-established temperature so as to turn on the halogen heaters via an AC driver if it is lower than the pre-established temperature while turning off the halogen heaters if it is higher than the pre-established temperature, thereby controlling the temperatures of the fixing roller 4*a* and the pressure roller 4*b* constant.

Figure 3:
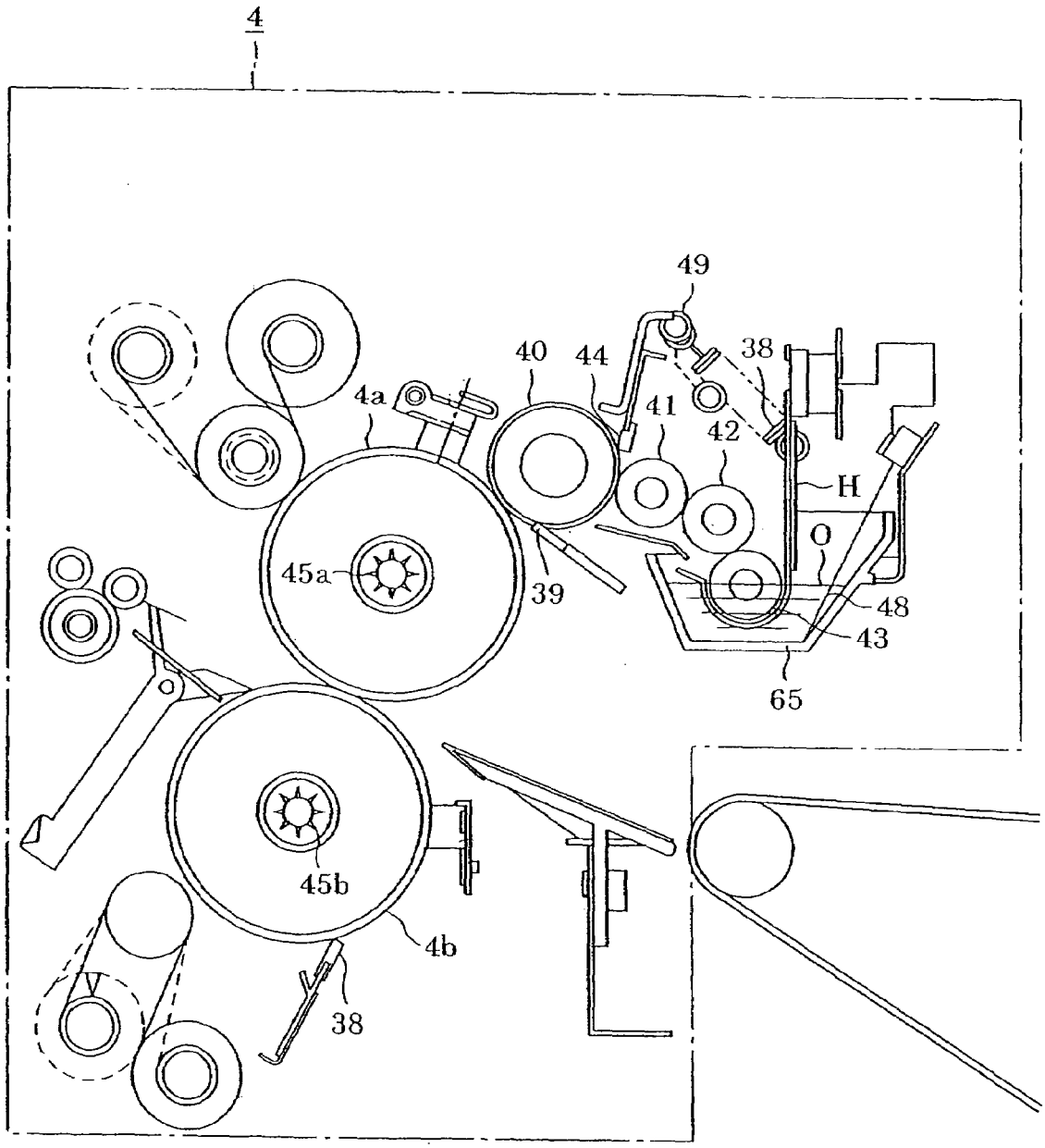
FIG. 3 is a front view of the fuser according to the present invention.

In the device shown in FIG. 3, part of a first pumping roller 43 is dipped in release oil O contained in an oil pan 65 while a second pumping roller 42 rotates adjoining the first pumping roller 43. A third pumping roller 41 is adjacent to the second pumping roller 42. The second pumping roller 42 is rotated by a drive source so as to transmit a driving force to a coating roller 40 for applying the release oil O via the third pumping roller 41 and the first pumping roller 43. The second pumping roller 42 also serves as the rotational center for urging the coating roller 40 to the fixing roller 4*a* by a pressure spring 38. In such a manner, the coating roller 40 applies the release oil O sequentially pumped by each of the pumping rollers on the surface of the fixing roller 4*a*. A metering blade 44 made of an elastic body, such as fluoride rubber, for restricting the release agent and urged by a spring 49 so as to constantly maintain a predetermined pressure is arranged in contact with the coating roller 40, thereby defining the amount of the oil on the coating roller 40 at a predetermined value. The oil on the coating roller 40 restrictedly applied thereon is transferred to the fixing roller 4*a*. The residual oil on the coating roller 40 is removed outside the oil pan 65 by a cleaning blade 39 together with toner and paper dust stuck on the fixing roller 4*a*. This residual oil is recovered to an oil tank, which will be described later, via a filter for recycling.

An oil application unit will be described in detail. The passing amount of the oil O pumped up by the first pumping roller 43 is restricted to some extent with a gap to the second pumping roller 42. The gap between the first and second pumping rollers generally has a predetermined value (about 0.1 mm to 0.3 mm), with which the oil passing amount is determined. The silicone oil O having passed through this gap is pumped to a gap between the third pumping roller 41 and the second pumping roller 42. The second pumping roller 42 has grooves with a depth of about 0.1 mm formed on the surface, and the oil O remaining in the grooves is transferred to the third pumping roller 41. The third pumping roller 41 comes in contact with the coating roller 40 so as to slightly invade it, and has a small surface roughness of Ra 3.2 so as to avoid damage to the coating roller 40 with the silicone rubber surface. The material of each pumping roller is a metal. Then, the oil O transferred from the third pumping roller 41 is conveyed to the metering blade 44 for restricting the release agent along the surface of the coating roller 40. The coating roller 40 is made up of a silicone rubber surface and a formed silicone sponge internal surface, which are fixed on a metallic core.

The metering blade 44 is rotatable about a rotational axis, and is urged to the coating roller 40 at a predetermined pressure by the-spring 49. Thus, the passing amount of the oil on the coating roller 40 is restricted to have a desired value by passing through a contact gap to the metering blade 44. The oil O is applied at an optimum film thickness to the fixing roller 4*a* via the nip to the fixing roller 4*a*.

The length of the second pumping roller 42 is larger than the distance between flanges for securing a gap arranged on both sides of the first pumping roller 43. The length of the third pumping roller 41 is smaller than those of the second pumping roller 42 and the oil coating roller 40, and both ends of the third pumping roller 41 are tapered so as to avoid damage to the surface rubber of the coating roller 40. The length of the coating roller 40 is 301 mm in consideration of a positional allowance ±2 mm of paper with a maximum document A3 size of 297 mm; and the length of the metering blade 44 is increased longer than that of the coating roller 40 so as to restrict the full surface.

A thermistor 48 is arranged in the oil, and an oil temperature is detected by a controller so as to control the temperature at a predetermined value by passing electric current through a surface heater H via an AC driver. Hence, the fusing stability during machine startup can be ensured, and gloss variation due to a variation in the amount applied of oil can be prevented.

Figure 4:
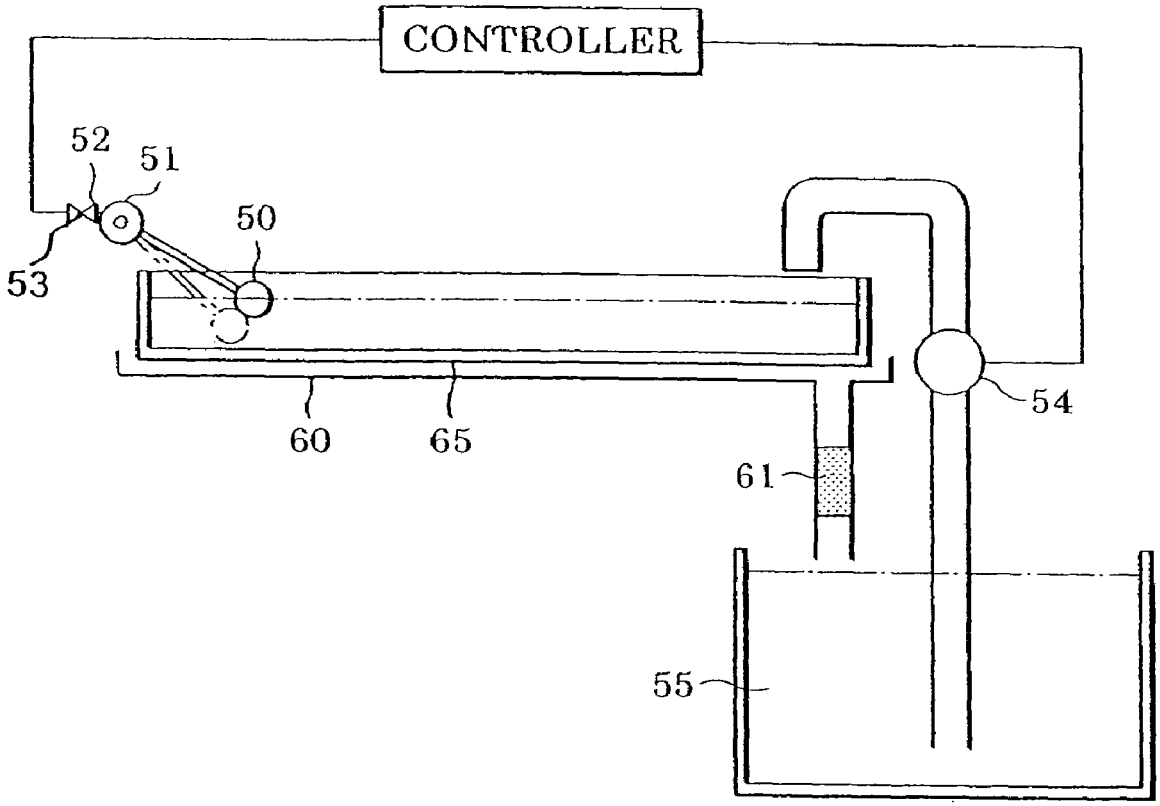
FIG. 4 is a drawing showing oil circulation of the fuser according to the present invention.

FIG. 4 is a side view of the oil pan 65: a float 50 is floating on the oil O contained in the oil pan 65; the float 50 is rotatably supported by a shaft 51 so as to move up and down in accordance with an oil level, and a flag 52 arranged so as to oppose the float 50 also rotates simultaneously. Thus, if the amount of the oil O is reduced by consumption, a sensor 53 cannot detect the flag 52, so that an oil pump 54 is driven by the body controller detecting that signal. At this time, the oil pump 54 pumps up oil into the oil pan 65 from the oil tank 55 arranged below the pump. If the sensor 53 detects the flag 52, the oil pump 54 is stopped operating so as to maintain the oil level of the oil pan 65 constant. The oil containing offset toner and paper dust scraped by the cleaning blade as described above drops into a recovery pan 60. The dirt in the recovered oil is removed with a filter 61, and the oil is again returned to the oil tank 55 for recycling use.

FIG. 1 is a drawing showing a drive system according to the embodiment of the present invention: a drive unit 9 in the body is structured to have a drive output from a drive motor unit including a motor 90 and a gear box 91 to a coupling 92 via a reduction gear train. The fuser can be pulled out of the body toward oneself (in arrow direction in the drawing) for jam disposal and maintenance, and is connected to the body drive unit 9 via a coupling 93. The drive force transmitted from the coupling is transferred to the fixing roller 4*a* via gears 94 and 95. The gear 94 is mated with a back-stop one-way gear 96 so that the fixing roller 4*a* cannot be rotated in a direction opposite to the conveying direction by an external force from a user, etc. The pressure roller 4*b* basically follows the fixing roller 4*a*, and it is driven to have a peripheral speed slightly smaller than that of the fixing roller 4*a* in case of slippage between the rollers. In order to prevent poor rotation due to the speed difference between the rollers, the speed difference is absorbed by using a one-way gear 97, which is locked in the driving direction, so that the one-way gear 97 idles in the following state of the fixing roller 4*a*. To the fixing roller 4*a*, a hand knob 98 is connected for jam disposal. From the gear 94, the drive force is transferred to the oil application unit so as to drive the coating roller 40.

On the other hand, a flywheel 103 is provided with gears 100 and 101 therebetween for increasing an inertial force. The flywheel 103 is controlled to have switched connection/disconnection by a magnetic clutch 102 connected between the flywheel 103 and the gear 101 under the control of the body controller. The number of teeth of the gear 101 is smaller than that of the gear 100, so that the flywheel 103 is driven to have an increased speed. Since the inertial energy of a flywheel increases in proportion to the square of an angular velocity, the flywheel can be miniaturized.

A control method according to the embodiment will be described below.

Figure 6:
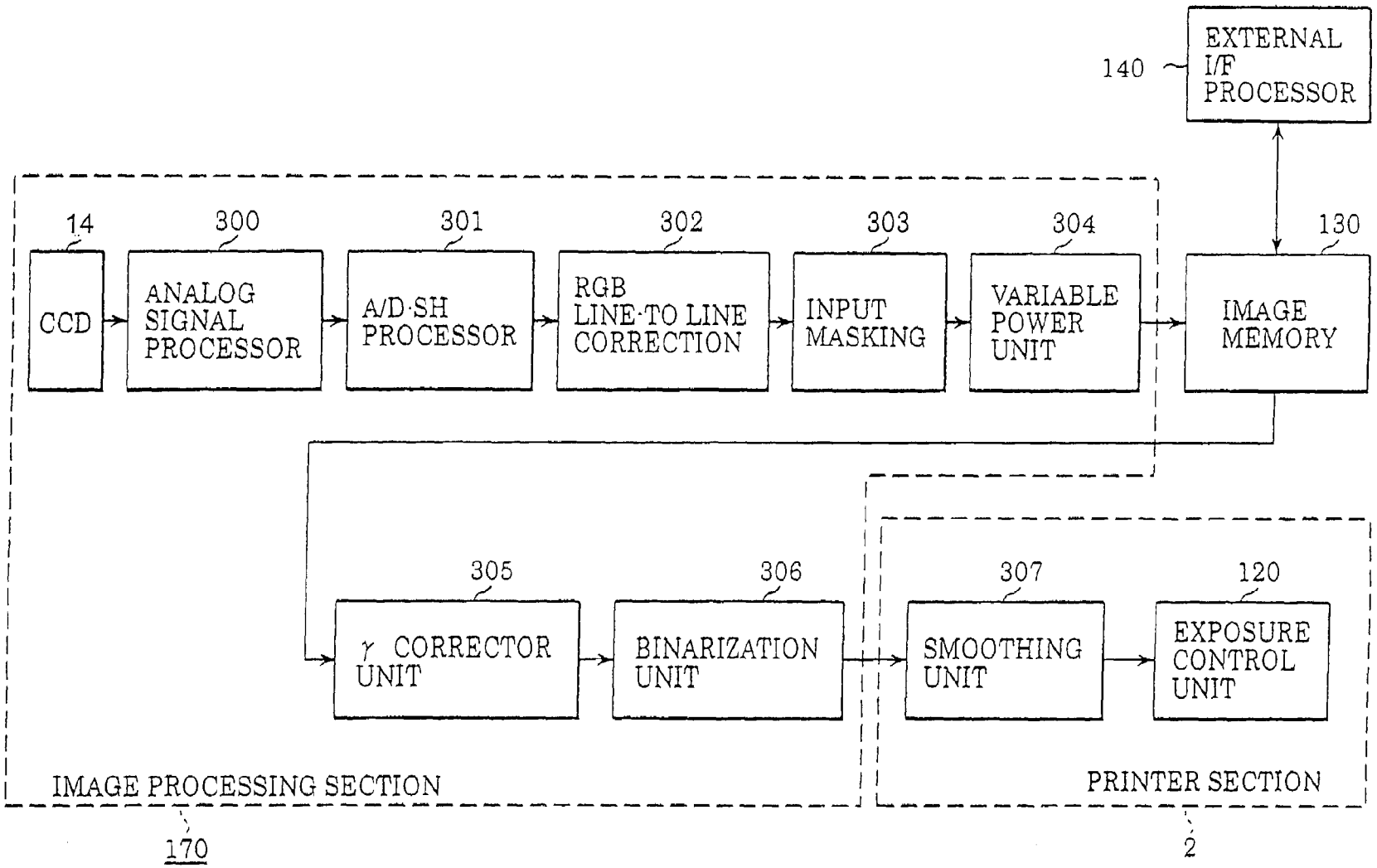
FIG. 6 is a block diagram showing an image processor according to the present invention.

FIG. 6 is a block diagram showing the internal structure of an image-forming section 170, and components connected to an image memory 130.

First, the flow of the printing process of scanned images will be described: a document image focused on the CCD 14 via the lens 13 is converted into an analog electrical signal by the CCD 14; The converted image information enters an analog signal processor 300 so as to be A/D (analog-to-digital) converted in an A/D-SH processor 301 after being corrected for sample-and-hold and dark level; and furthermore, shading correction is performed on the digitized signal. In the shading correction, dispersion in the CCD 14 for each pixel and positional dispersion in the light quantity due to light-distribution characteristics of a document illumination lamp 12 are corrected.

Then, in an RGB (Red, Green, Blue) line-to-line correction unit 302, RGB line-to-line correction is executed. At one time, since light rays entered in respective RGB light receiving units of a CCD sensor 14 are displaced with each other on the document corresponding to the positional relationship of the respective RGB light receiving units, RGB signals are synchronized at this time.

Then, in an input masking unit 303, an input masking processing is carried out so as to convert luminance data into density data. Original RGB values produced from the CCD 14 are affected by a color filter attached to the CCD 14, so that the effect is corrected for converting the values into pure RGB values.

Thereafter, in a variable power unit 304, images are vari-focused at a desired variable power rate, so that the vari-focused image data are transferred to the image memory 130 for storing.

Computer image data is also entered into image memory 130 from external I/F processor 140.

In the course of printing the stored images: first, image data are transferred to a y corrector unit 305 from the image memory 130; and in the y corrector unit 305, in order to make the output correspond to a density value established in an operation unit 203, original density data are converted into density data corresponding to a desired output-density value based on a look-up table (LUT) prepared in consideration of printer characteristics.

Then, the density data is transferred to a binarization unit 306. In the binarization unit 306, multiple-valued density data are binarized. In the multiple-valued density data, 8 bits of density data, for example, have any one of density values of 0 to 255; however, by the binarization, the density has only two values of 0 and 255. That is, in order to express the density of one pixel, 8 bits of data have been required, whereas, by the binarization, one bit of data is sufficient. As a result, the memory capacity required for storing image data is reduced; however, on the other hand, image gradation varies from the original gray scale of 256 to a gray scale of two, so that the quality of image data with a large number of half-tone images, such as picture images, may deteriorate as a result of binarization.

Then, pseudo-halftone image expression by the binarized data becomes important. An error diffusion technique is incorporated here for that expression. In this technique, if the density of one image is larger than a threshold value, the image has a density value of 255 while if it is smaller than the threshold value, the image has a density value of zero, so that after the binarization, a difference between actual density data and the binarized density data is obtained as an error signal so as to distribute the error signal to circumferential pixels. The error distribution is executed by multiplying a predetermined weighting coefficient on a matrix by an error due to the binarization so as to add the product to circumferential pixels. Consequently, the average density value of the entire images is maintained so that the pseudo-halftone image can be expressed by the binarization.

The binarized density data are transferred to a smoothing unit 307 in a printer section 2. In the smoothing unit 307, the data are complemented so that ends of the binarized image line are smooth, and the complemented image data are produced to an exposure control unit 120. The exposure control unit 120 controls the irradiation timing from the laser beam source 21 on the respective color photosensitive drums 23 so as to form latent images of the image data.

An external I/F processor 140 is an interface for transferring image data in the image memory 130 to a desired computer via a network.

Figure 7:
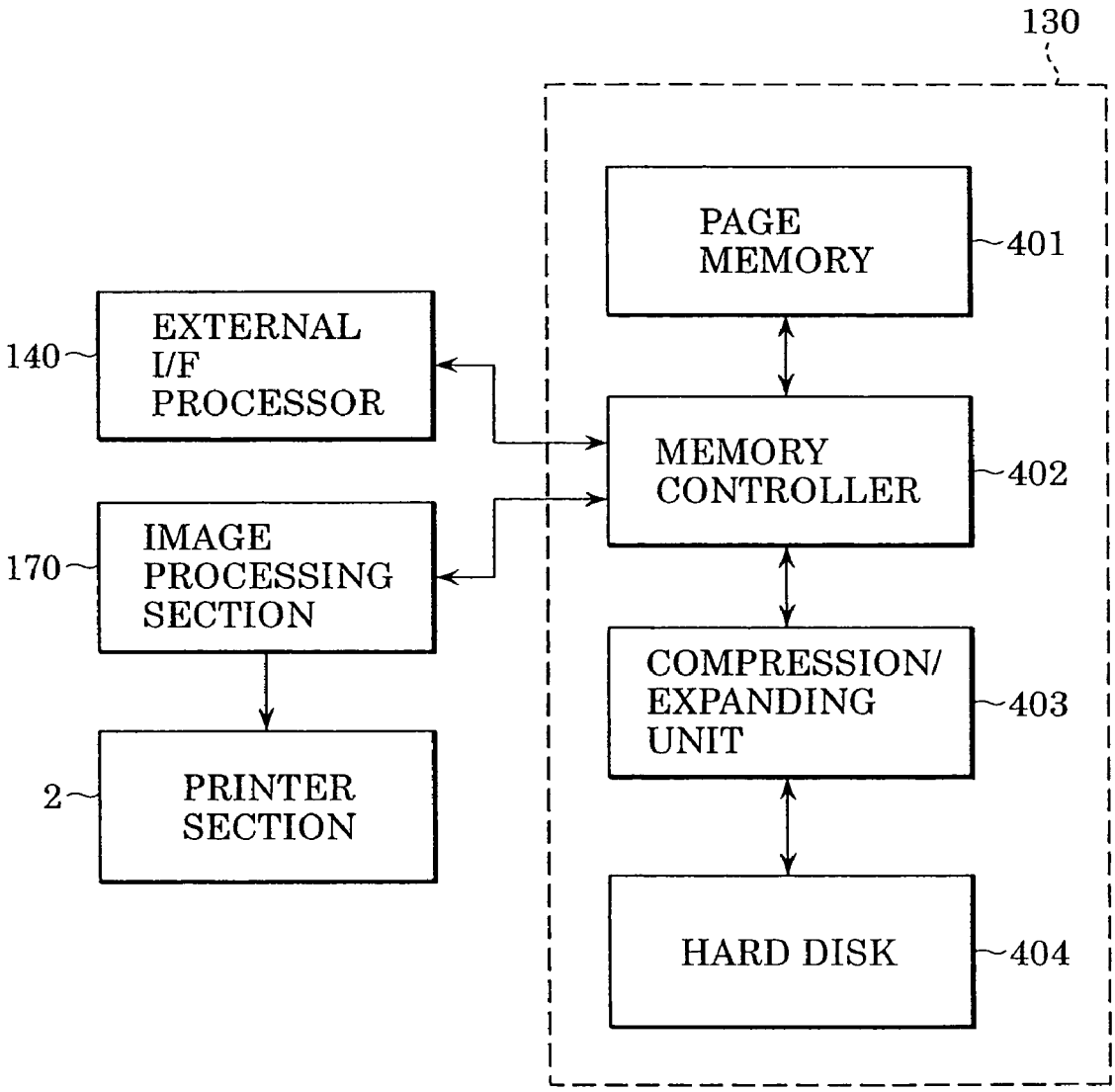
FIG. 7 is a block diagram showing an image memory and peripheral devices.

FIG. 7 is a block diagram showing an internal structure of the image memory 130, and peripheral devices.

The image memory 130 is composed of a page memory 401, a memory controller 402, a compression/expanding unit 403, and a hard disk 404.

The image data supplied from the external I/F processor 140 and the image-processing section 170 to the image memory 130 are written in the page memory 401 by the memory controller 402, and then, are fed to the printer section 2 or stored in the hard disk 404. When the image data are stored in the hard disk 404, the image data are compressed in the compression/expanding unit 403, and are written in the hard disk 404 as compressed data. The image data stored in the memory controller 402 or the hard disk 404 are also read out to the page memory 401. At this time, the compressed data read out of the hard disk 404 is expanded through the compression/expanding unit 403 so as to write the expanded image data in the page memory 401. The memory controller 402 generates a DRAM refresh signal for feeding the signal to the page memory 401, and also adjusts the access to the page memory 401 from the external I/F processor 140, the image-processing section 170, and the hard disk.404. Furthermore, the memory controller 402 controls the determination of a writing address to the page memory 401, a reading address from the page memory 401, and a reading direction in accordance with the instruction of a CPU 201. By these processions, the CPU 201 can control the producing function to the printer section 2 via the image-processing section 170, the function producing part of images by cutting only the part thereof, and the rotating function of images after a plurality of document images are laid out in the page memory 401.

With regard to a sort mode, for a bundle of documents, a process in that images are readout in the order of being recorded in the image memory 130 so as to print them is repeated multiple times. By such a control process, even a finisher having a small number of bins can serve the same function as that of a finisher having a large number of bins.

Figure 8:
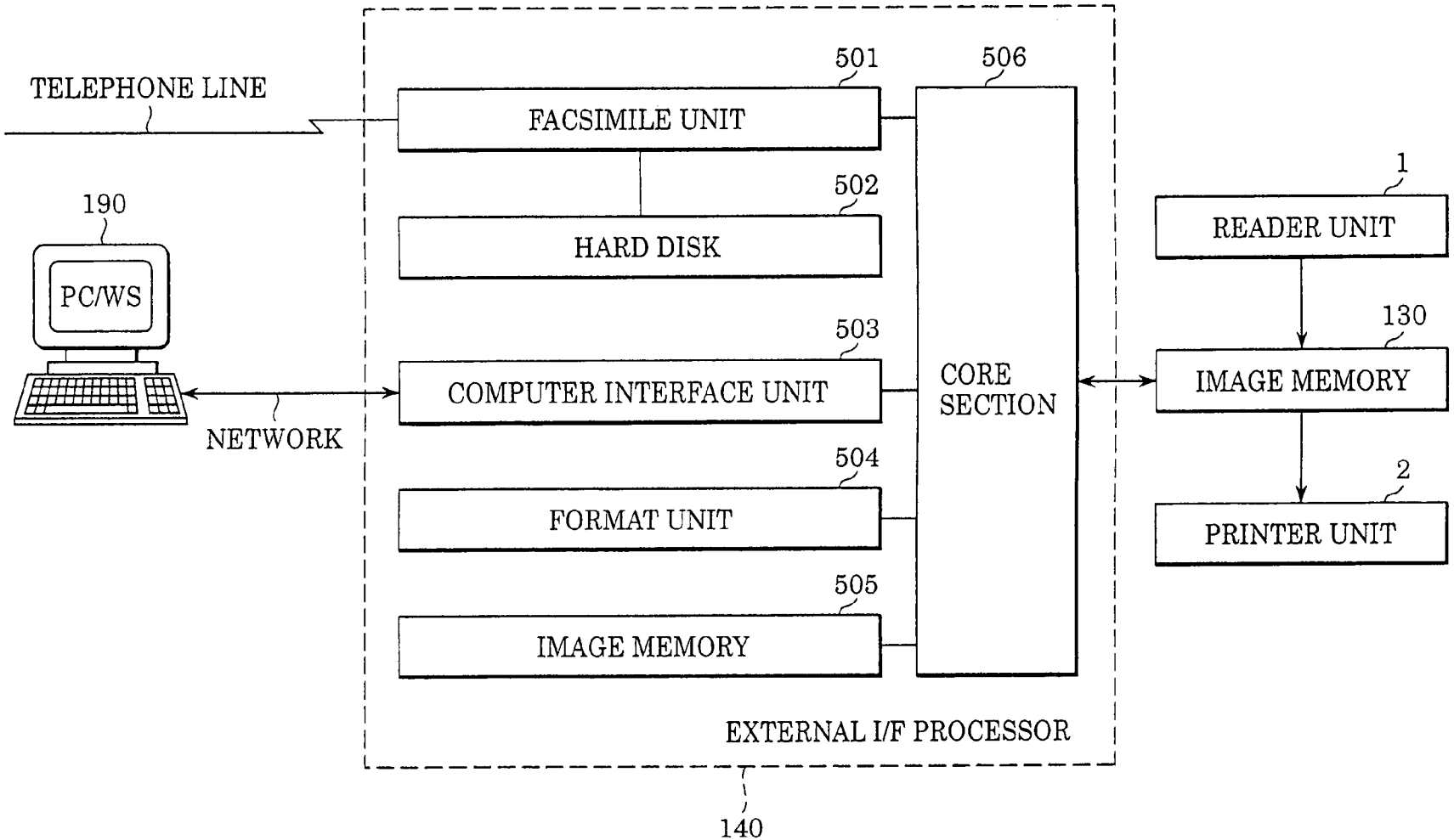
FIG. 8 is a block diagram showing an external I/F processor and the peripheral devices.

FIG. 8 is a block diagram showing the internal structure of the external I/F processor 140, and peripheral devices. The external I/F processor 140 brings in image data from the reader unit 1 via the image memory 130 so as to be supplied to external computers or external facsimile machines through a network or telephone lines. Also, by the external I/F processor 140, image data fed from external computers or external facsimile machines over a network or telephone lines are produced to the printer section via the image memory 130 and the image-processing section 170 so as to form images.

The external I/F processor 140 is composed of a core section 506, a facsimile section 501, a hard disk 502 for storing communication image data of the facsimile section 501, a computer interface section 503 for connecting external computers 190, a format section 504, and an image memory 505.

The facsimile section 501 is connected to a public circuit through a modem (not shown), thereby receiving facsimile communication data from the public circuit and sending facsimile communication data to the public circuit. The facsimile section 501 achieves facsimile functions of sending facsimile data at a designated time and sending image data corresponding to an inquiry through a specific password by using facsimile images stored in the hard disk 502.

Thus, after images are first supplied to the facsimile section 501 through the image memory 130 from the reader unit 1 so as to store them in the facsimile hard disk 502, facsimile data can later be sent without using the reader unit 1 and the image memory 130 as facsimile functions.

The computer interface section 503 is an interface for communicating data to external computers 190, and includes a local area network (LAN), a serial I/F, a SCSI-I/F (small computer systems interface), and a Centronics I/F for inputting printer data. Through the computer interface unit 503, external computers 190 are informed of states of the printer section 2 and the reader unit 1. Alternatively, under instructions from an external computer 190, images readout in the reader unit 1 are transferred to the external computer 190.

The computer interface section 503 also receives print image data from external computers 190. At this time, since the print image data supplied from the external computers 190 are described under a dedicated printer code, in the format unit 504, the supplied data code is converted into raster image data capable of forming images in the printer section 2. The converted raster image data are developed in the image memory 505 by the format section 504. On the other hand, when image data are sent to external computers 190 via the computer interface unit 503, the image format unit 504 transforms the gray level of print image data supplied from the image memory 130 and also converts the print image data into an image format recognizable by the external computers 190 in the image memory 505.

The image memory 505 is also used in sending (network scanning function) image data from the reader unit 1 to external computers 190 in addition to be used as a memory developing the raster image data in the format unit 504 in such a manner. That is, when images from the reader unit 1 are sent to external computers 190 via the computer interface unit 503, image data supplied from the image memory 130 are once developed in the image memory 505 so as to convert them here into a data format transmissible to external computers 190, and then, the image data is fed from the computer interface unit 503 to the external computers 190.

The core section 506 controls data transfer executed among the facsimile unit 501, the computer interface unit 503, the format unit 504, and the image memory 505, and the image memory 130. Thereby, even when a plurality of image outputs are connected to the external I/F processor 140, or when there is only one image transfer path to the image memory 130, exclusion control and priority control are performed under the administration by the core section 506, so that images are appropriately outputted.

Figure 9:
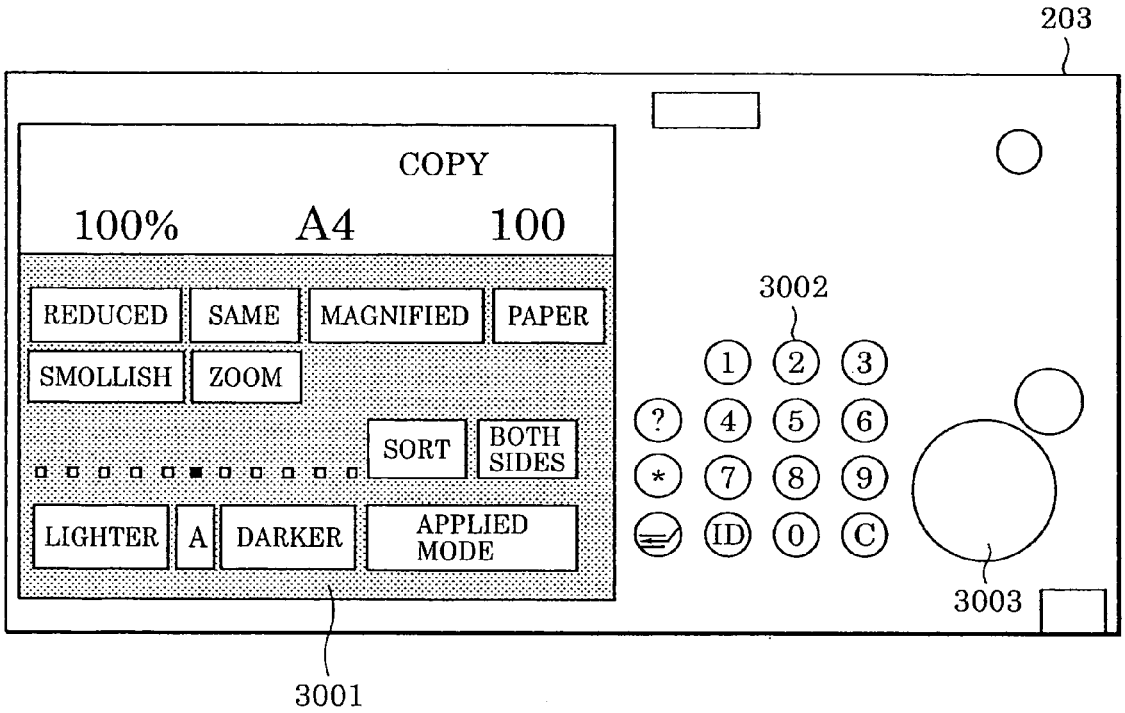
FIG. 9 is a drawing showing an operation unit.

FIG. 9 is a schematic view showing a structure of the operation unit 203 of the image-forming apparatus.

Referring to the drawing, on a display 3001, various messages, such as operating states of the apparatus and operating instructions to a user, and operating procedures are displayed.

The surface of the display 3001 is a touch panel that serves as a selector key by touching thereon. A ten-key pad 3002 is a numerical pad for inputting numerals. By pushing the copy key 3003, copying operation is started.

With the operation unit, a user can specify the paper kind of the recording material to be used, the paper thickness, and copying density. When using as a printer, a user can specify the paper kind, the paper thickness, and copying density through an external computer 190.

Figure 10:
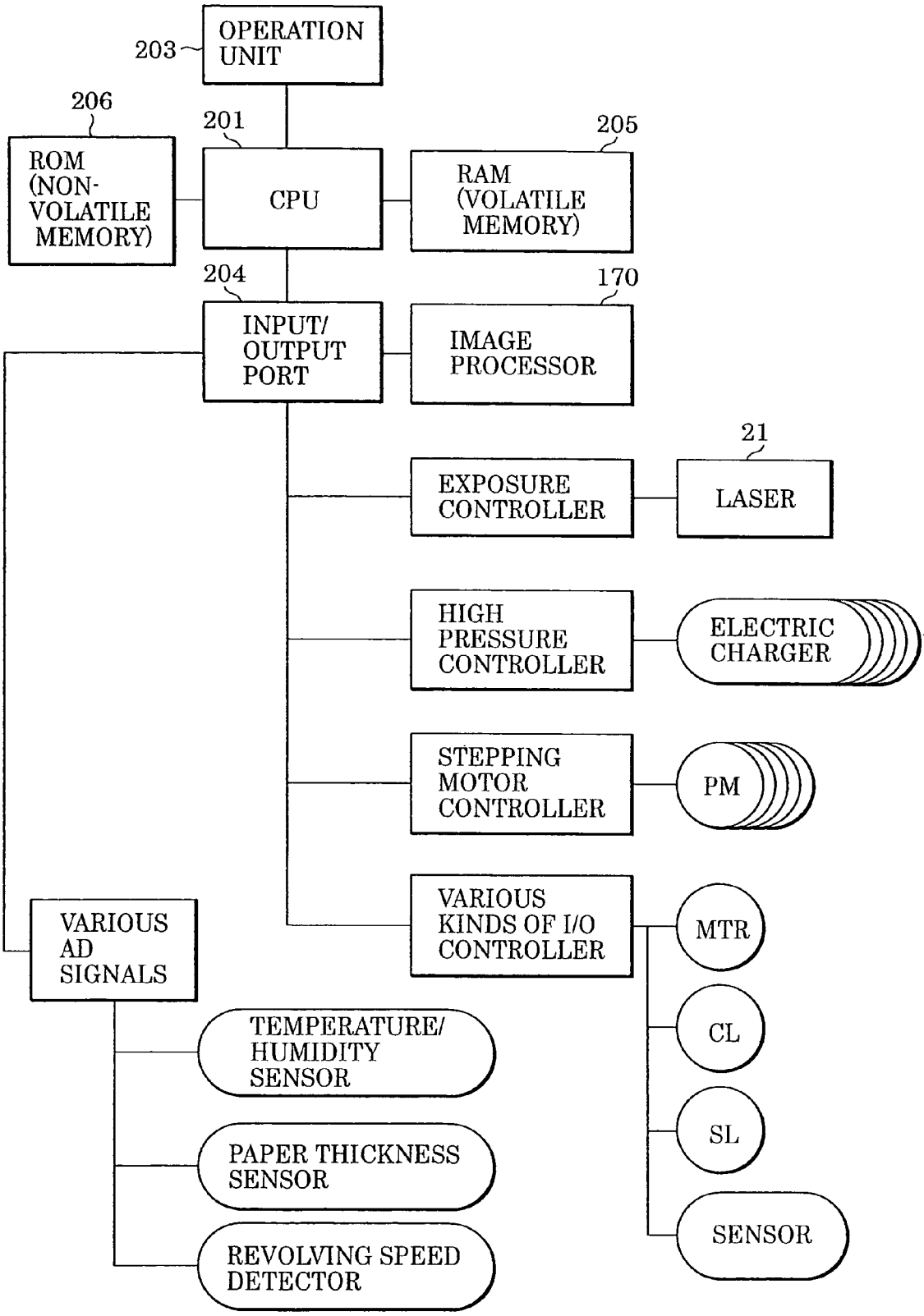
FIG. 10 is a block diagram of an operational control unit.

FIG. 10 is a block diagram of an operation control unit of the image-forming apparatus. A CPU 201 basically controls the image-forming apparatus, and has an ROM 206 having control programs written therein, a work processing RAM 205, and an input/output port 204 connected to the CPU 201 through an address bus and a data bus. Part region of the RAM 205 is a backup RAM in that data cannot be wiped out even if the power supply is turned off. To the input/output port 204, various work load devices controlled by the image-forming apparatus, such as a motor and a clutch, and input devices to the image-forming apparatus, such as a sensor for detecting a position of paper, are connected.

The CPU 201 sequentially controls an input/output through the input/output port 204 in accordance with control programs of the ROM 206 so as to execute the image-forming process.

The operation unit 203 is also connected to the CPU 201 that controls the display and key input portion of the operation unit 203. As described above, a user instructs the CPU 201 to switch the image-forming operation mode and switch the display through the key input, and the CPU 201 displays operation states of the image-forming apparatus and the operation mode established by the key inputting on the display of the operation unit 203.

To the input/output port 204, an exposure controller for controlling to turn on the laser 21 for forming latent images on the drums from image data as described above, a high pressure controller, such as the electric charger 24 and the transfer charger 26, a stepping motor controller for controlling a stepping motor for feeding and conveying recording materials, a fuser motor (MTR), a solenoid (SL), and various kinds of I/O controller for controlling sensors, such as a photo-interrupter, are connected. Also, the CPU exchanges data of various AD signals, such as a temperature/humidity sensor, a paper thickness sensor, and a rotational speed sensor of the fuser motor, so as to control the high voltage output of the charger, for example, in accordance with the data.

Figure 11:
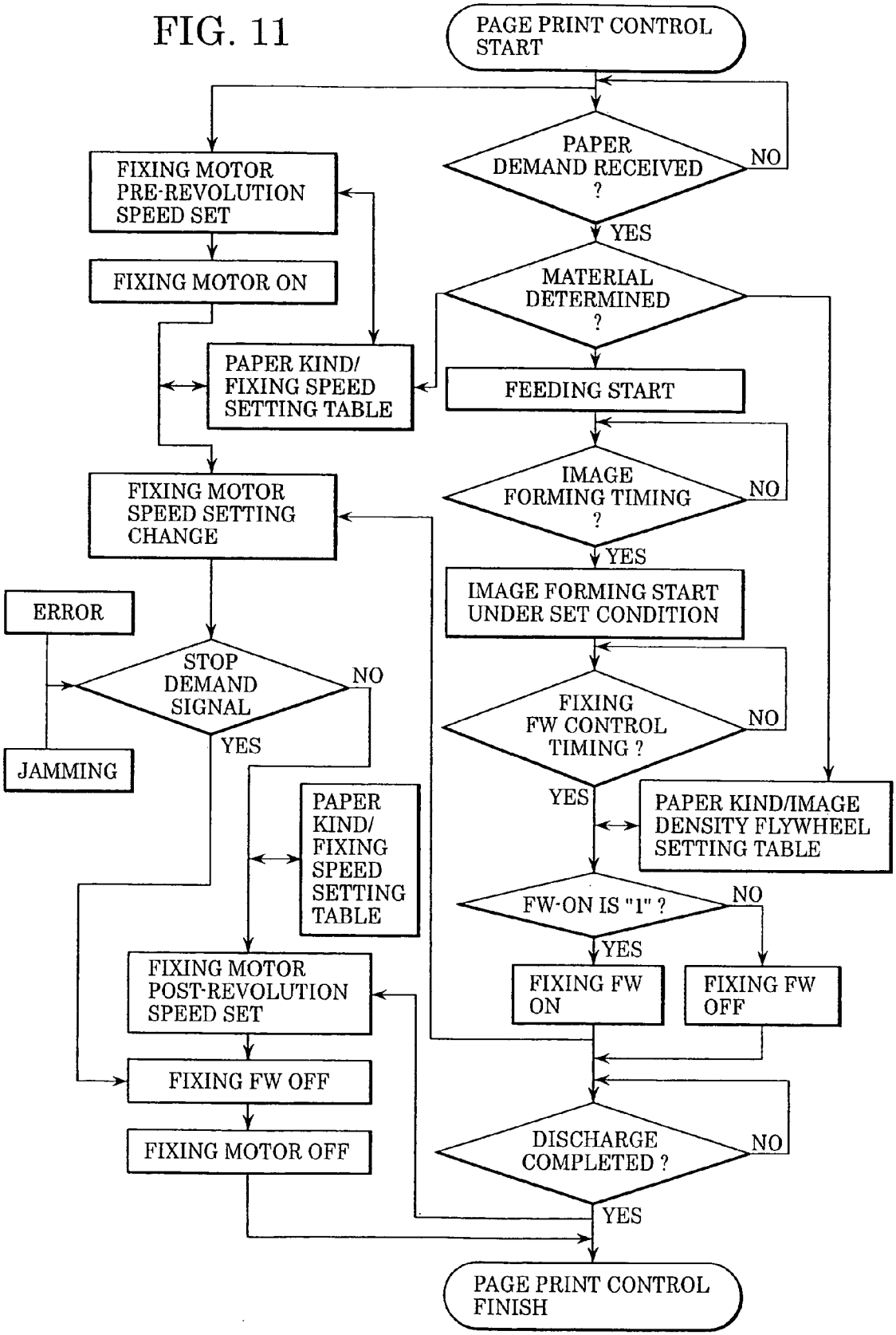
FIG. 11 is a flowchart of connection control of a flywheel.

The connection control of the magnetic clutch 102 for the flywheel 103 will now be described. FIG. 11 is a control flowchart of the embodiment.

Upon starting page print, the fuser motor 90 is started at a quarter of the fixing speed of normal paper according to a speed setting table.

By the input from a user or by an automatic detection, the kind and the thickness of the recording material is specified so as to optimize image-forming conditions, such as the output of the charger, and to determine the connection state of the flywheel.

FIG. 12 includes setting tables for the flywheel, in which, depending on the image density and the kind of paper, the flywheel is established whether it is connected or not.

The solid-color image density (maximum density) for each color is designated as 100%, i.e., up to 400% because of four colors, and the density data are transferred from the image-forming unit 170 to the CPU 201.

Figure 5A:
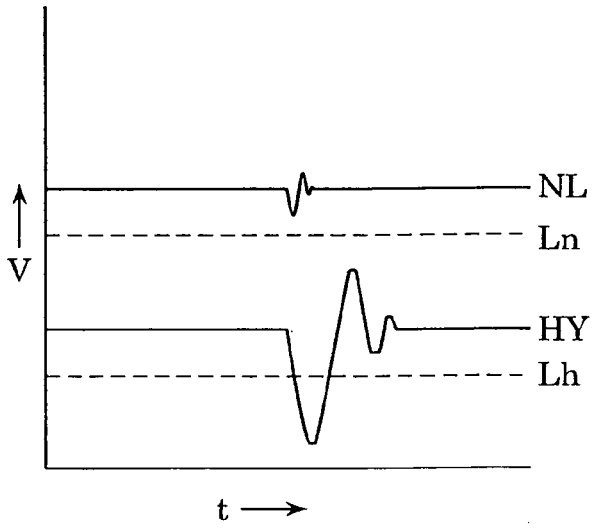
FIGS. 5A and 5B are graphs showing rotational variations of a fixing roller.
Figure 5B:
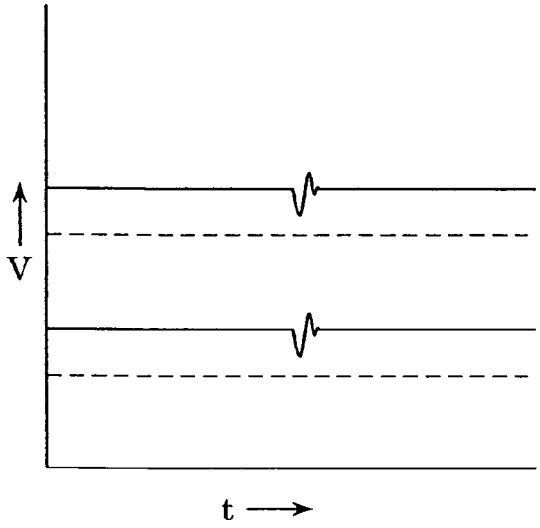

FIGS. 5A and 5B include graphs showing rotational variations of the fixing roller, plotting time in abscissa and fixing speed in ordinate. Symbol HY represents variations of the fixing speed when heavy cardboard digs into the fixing nip without the flywheel connected thereto; symbol NL represents the behavior of normal paper; symbols Ln and Lh denote limits that the shock during the digging affects images. The image defect does not appear on normal paper even without the flywheel.

Thus, in the case of thin paper and normal paper with a basis weight less than 150 g/m$^2$ in that the fixing speed is high and the shock is small when the recording material runs into the fixing nip, the state that the flywheel is released and not connected over the entire image density range is maintained.

On the other hand, in the case of heavy cardboard with a basis weight more than 150 g/m$^2$ in that the fixing speed is slow and the shock is large when the recording material runs into the fixing nip, the flywheel is connected over the entire image density range.

In the case of cardboard with an intermediate thickness between the normal paper and the heavy cardboard and having a basis weight less than 150 g/m$^2$, the flywheel is connected in a density range more than 100% because only the shock of high density images is conspicuous.

In an OHP sheet (over head projector sheet), which is an optically transparent resin sheet, the flywheel is released over the entire image density range.

In the case that the flywheel is connected according to a flywheel setting table, the magnetic clutch 102 is turned on after the fixing roller is started, and then, the fixing roller is sped up to each speed.

In such a manner, by connecting the flywheel at low speed, the load applied to the driving system (gears) due to impact during connection of the flywheel is alleviated.

In order to secure power fusing, the fixing speed is established as follows: where the rotational speed of normal paper or thin paper denotes V, the fixing speed for cardboard is ⅔V; ½V for heavy cardboard; ⅓V for the OHP sheet; and ¼V for pre-revolution and post-revolution.

Upon finishing the printing and discharging recording materials outside the machine, the speed of the fuser motor 90 is changed to the post-revolution speed according to the speed setting table, and then, the magnetic clutch 102 is turned off so as to release the flywheel. Upon completing the post-revolution, a series of page print controls is finished.

If an abnormal situation, such as error and jam, occurs, the flywheel is released, and then, the fuser motor 90 is stopped (electric power supply to the fuser motor is stopped), so as to avoid damage of the body by reducing an inertial force and the time until the fixing roller stops. If the flywheel is released at the same time the fuser motor is stopped, the stop time can be further reduced effectively.

According to the embodiment, the revolving speed (the number of revolution per unit time) of the fuser motor 90 (DC motor) is detected by the revolving speed detector (FIG. 10), and the body controller (CPU) controls drive of the fuser motor in accordance with the detected revolving speed.

If the detected revolving speed of the fuser motor varies from a predetermined speed, the controller determines that an abnormal situation occurs in the fuser motor so as to produce an error signal and to display error occurrence on the display of the operation unit. At this time, a stop signal is produced together with the error signal so as to forcedly stop the fuser motor.

The error signal may be sent to a personal computer network connected to the image-forming apparatus with an LAN cable so as to display the fuser motor error on a monitor of the personal computer.

During operation of the magnetic clutch, i.e., when the flywheel is connected and released, by ignoring the signal from the revolving speed detector for two seconds, error detection is prevented in that the abnormal revolving speed occurs although it is not generated.

In such a manner, the error detection due to variations of the revolving speed in the fuser motor when the flywheel is connected and released is avoided so as to successively control the fuser motor so that the fuser motor approaches the fixing speed as soon as possible.

According to the embodiment, the color printer is exemplified; alternatively, a monochrome printer may also incorporate the invention, and in particular the invention is effectively incorporated to a printer where the distance between an image-forming unit and a fuser is small.

[Second Embodiment]

In a second embodiment, the flywheel is provided adjacent to a fixing roller gear. If there is a space for arranging the flywheel above the unit, this embodiment is more advantageous for reduced rotational variations due to a shock because the number of drive trains is small so that effects of deflection and backlash are smaller. Like reference numerals designate like portions with the same functions.

With the fixing roller gear 95, an adjacent gear 104 with a small number of teeth is mated so as to drive and increase the flywheel 103 in speed. In the same way as in the first embodiment, the magnetic clutch 102 can be connected to control it. Since the number of revolution of the flywheel is smaller than that of the first embodiment, the flywheel with a larger diameter is used for having the same effect.

The control is the same as that of the first embodiment.

[Third Embodiment]

Figure 13:
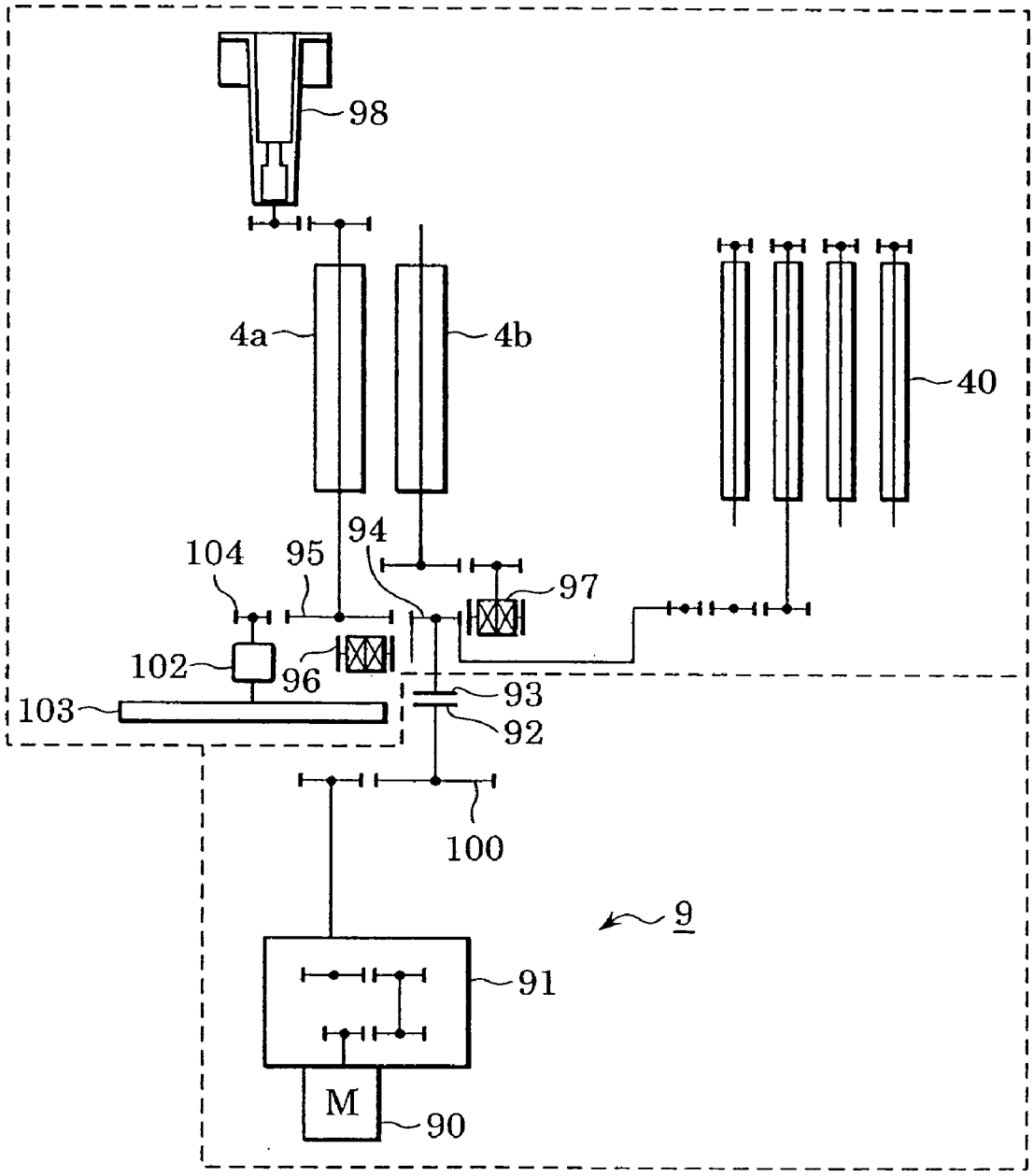
FIG. 13 is a drawing showing another embodiment.
Figure 14:
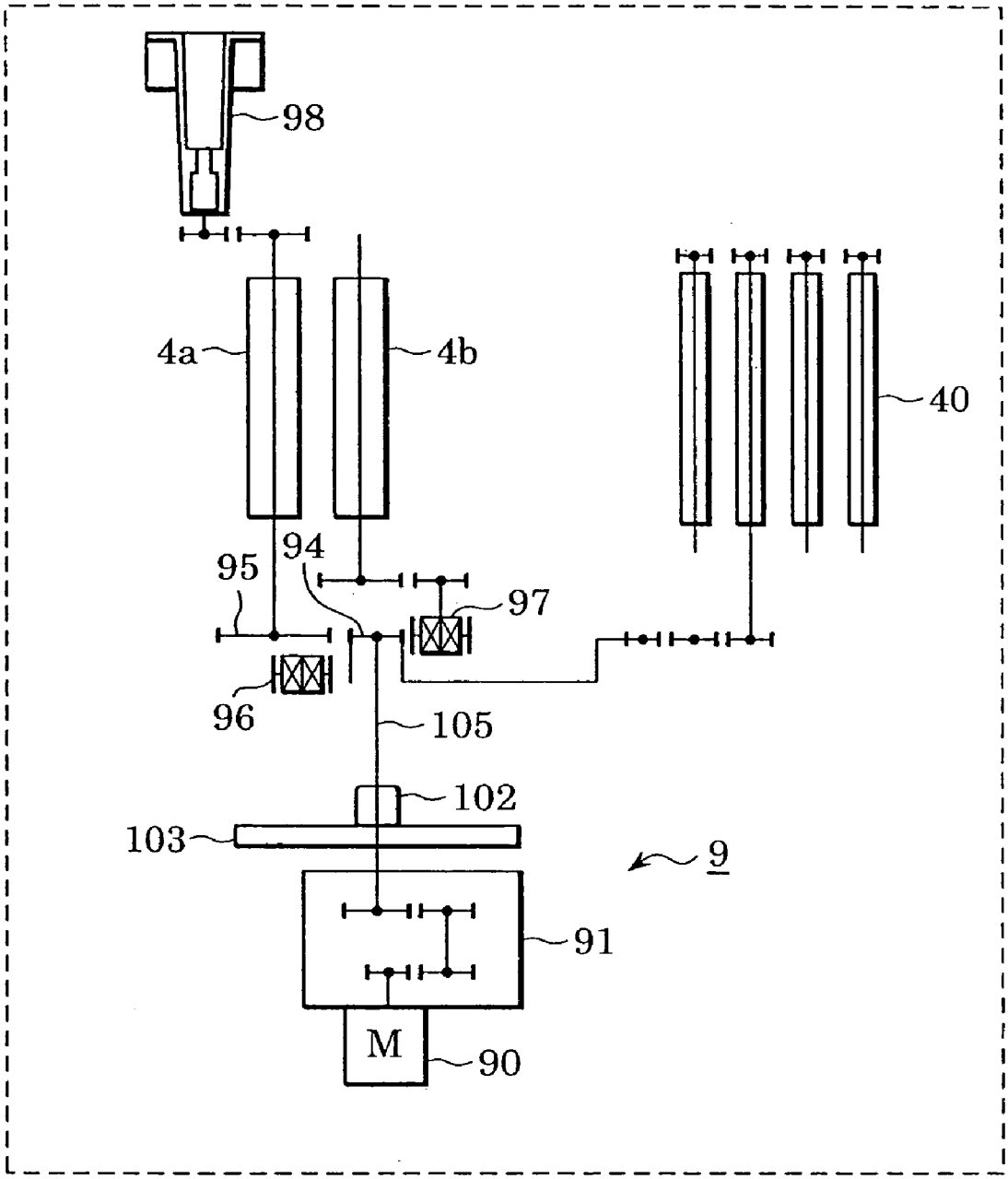
FIG. 14 is a drawing showing another embodiment.
Figure 15:
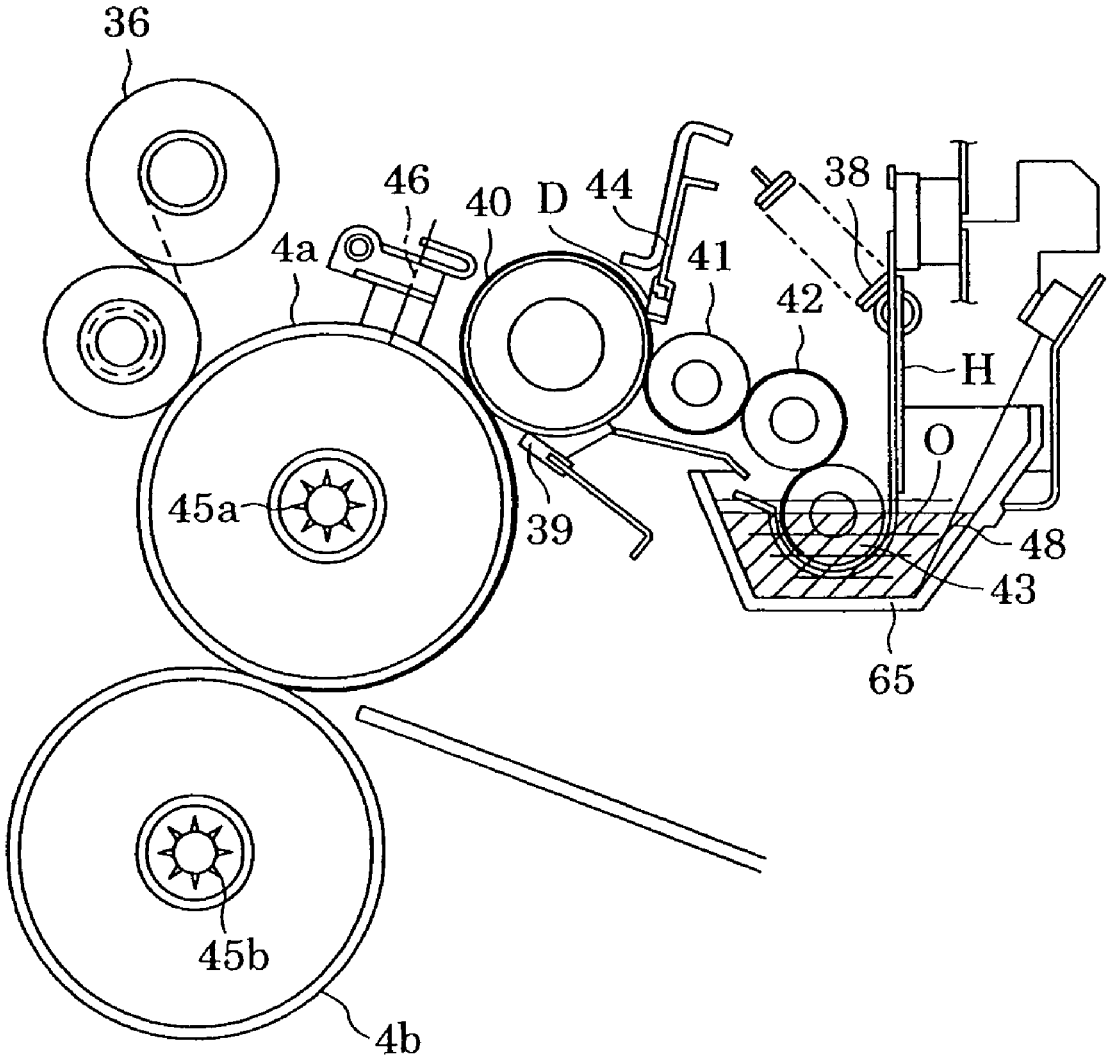
FIG. 15 PRIOR ART
FIG. 15 is a drawing showing a conventional example.
Figure 16:
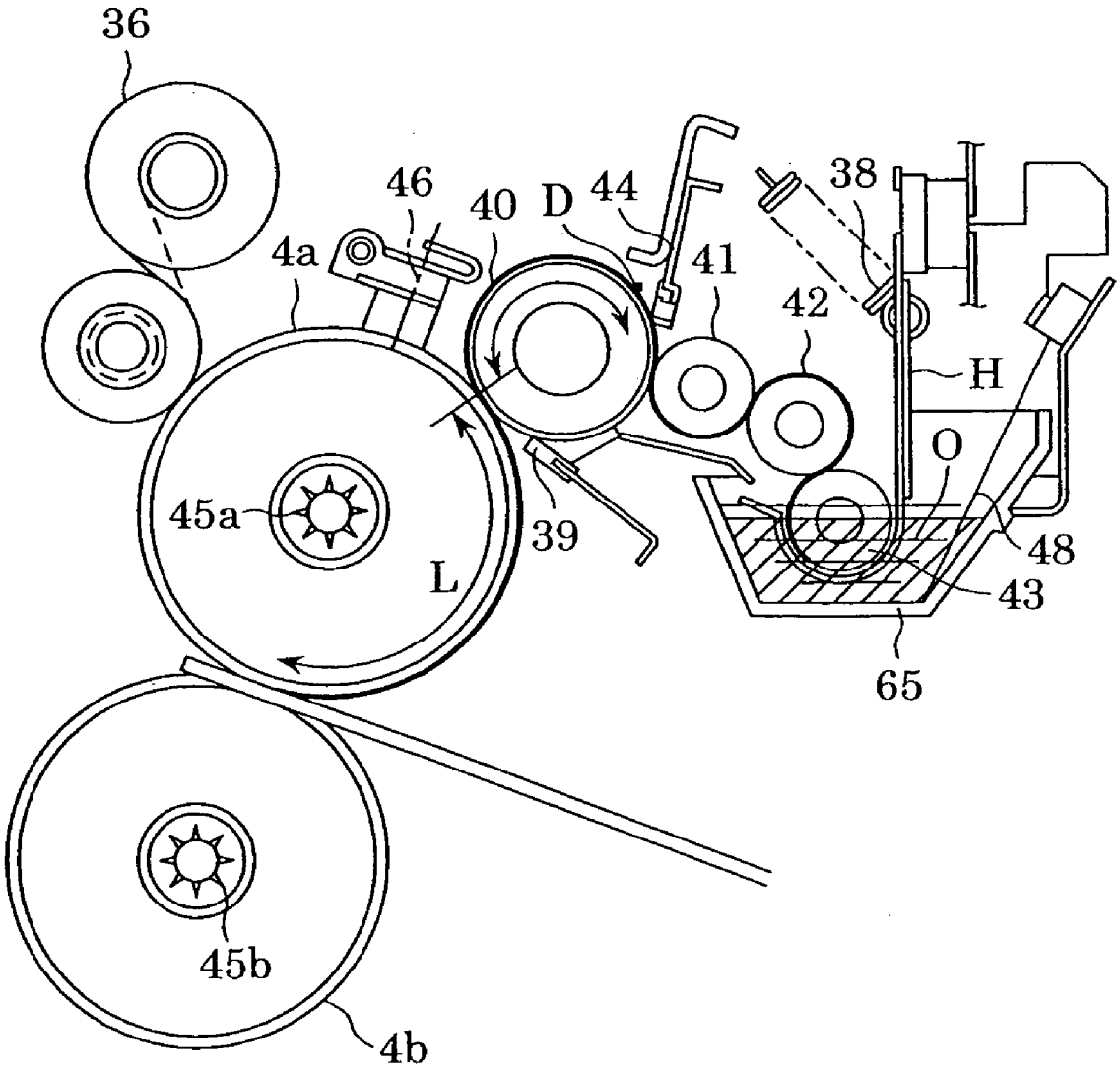
FIG. 16 PRIOR ART
FIG. 16 is a drawing showing a conventional example.
Figure 17:
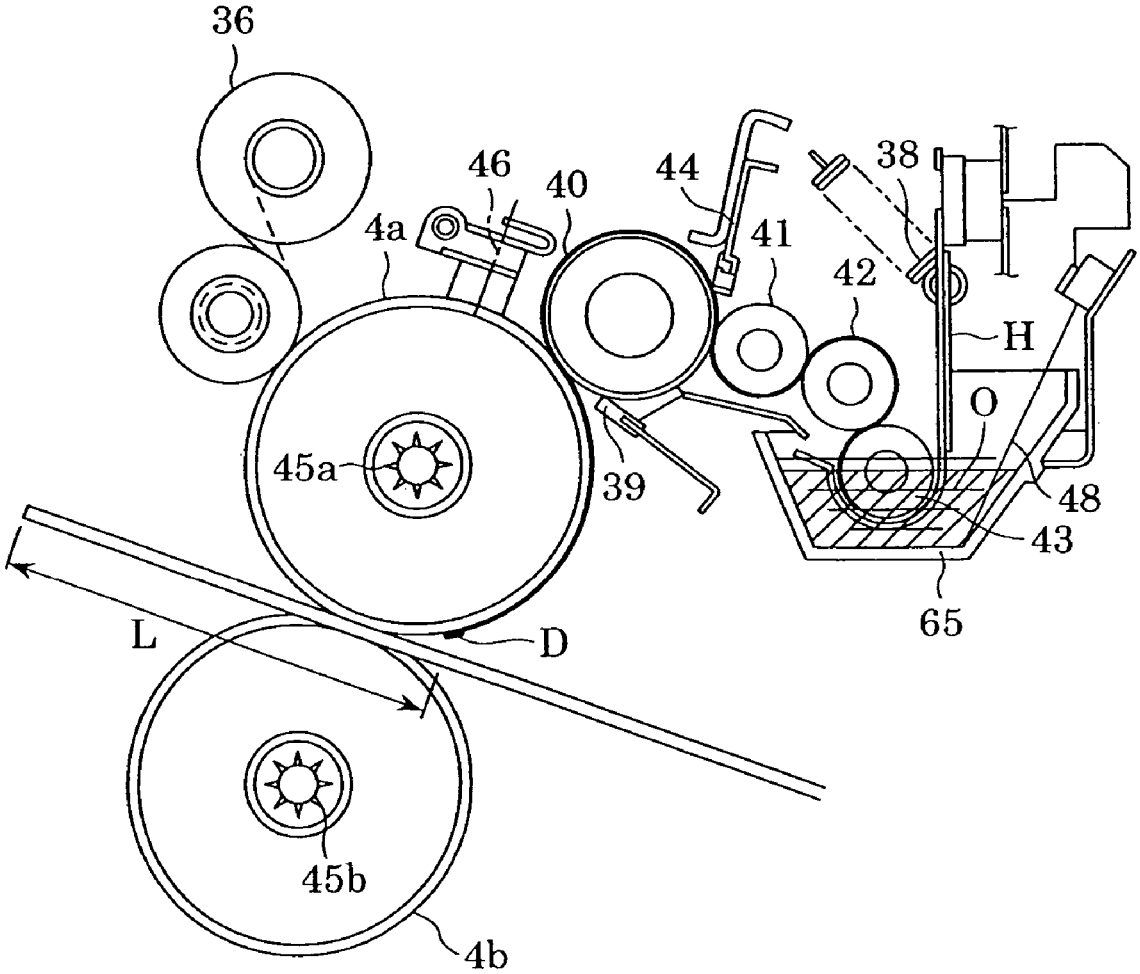
FIG. 17 PRIOR ART
FIG. 17 is a drawing showing a conventional example.
Figure 18:
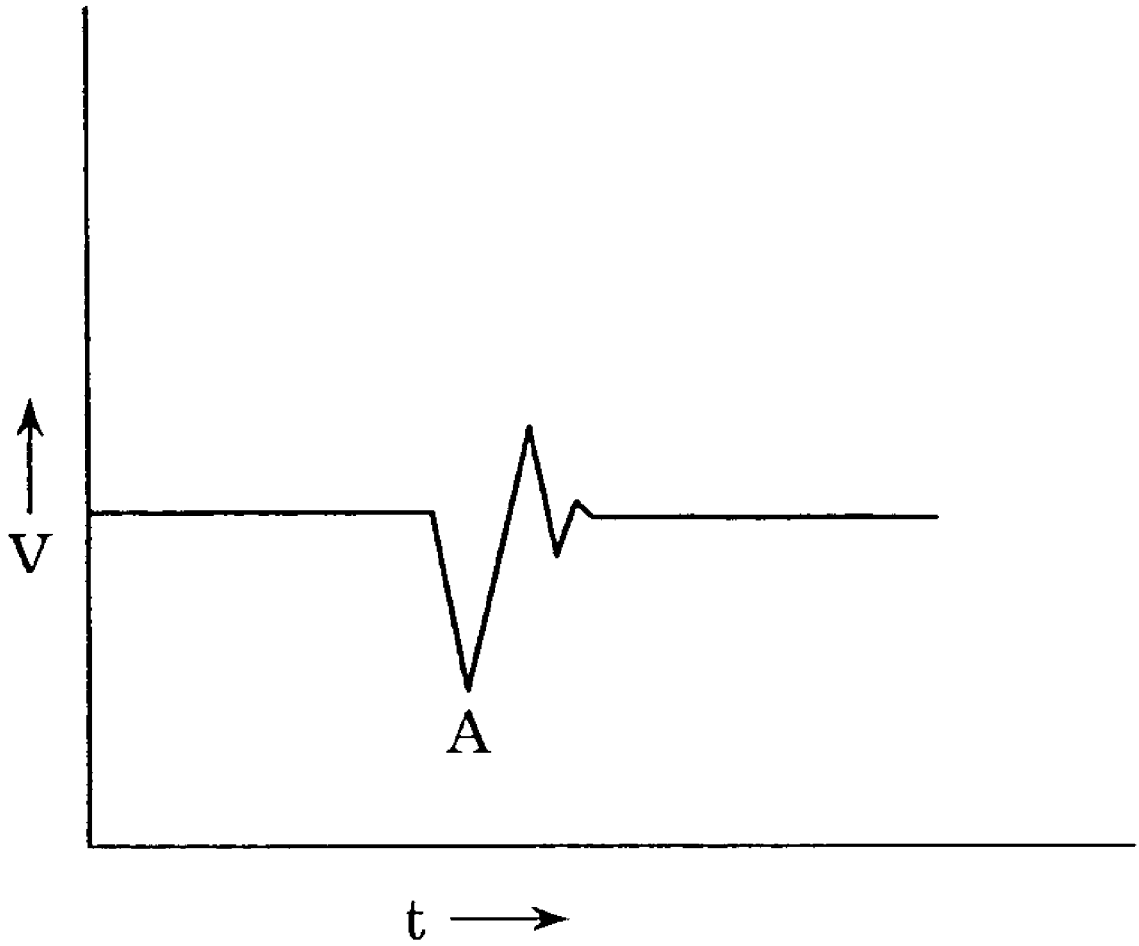
FIG. 18 is a graph showing rotational variations of a peripheral speed of a fixing roller in a conventional example without the flywheel.

A third embodiment is another example where the flywheel is provided adjacent to the fixing roller gear. If there is a space for arranging the flywheel and the motor above the unit, this embodiment is more advantageous for reduced rotational variations due to a shock because the number of drive trains is small and furthermore, effects of deflection and backlash are smaller. With reference to FIG. 13, like reference numerals designate like portions with the same functions, as in the first embodiment.

With the fixing roller gear 95, an adjacent gear 94 with a small number of teeth is mated, and the flywheel 103 is fitted to a drive shaft 105 of the drive gear 94. In the same way as in the first embodiment, the magnetic clutch 102 can be connected, and during connection, an inertial load is applied to the drive shaft 105. Since the number of revolutions of the flywheel is smaller than that of the first embodiment, the flywheel with a larger diameter is used for having the same effect.

As described above, according to the present invention, by selectively connecting the inertial means, while a shock when the recording material runs into the fixing nip is prevented from affecting image quality, reduction in life of the drive system can be suppressed. Also, since a large sized device and components with high accuracy are not necessary, cost reduction is enabled.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

This application claims priority from Japanese Patent Application No. 2003-331932 filed Sep. 24, 2003, which is hereby incorporated by reference herein.

What is claimed is:

1. An image forming apparatus comprising:

image forming means for forming an image on a recording material;

a fixing member for fixing the image on the recording material at a fixing nip;

drive transmitting means for transmitting a driving force of a driving motor to said fixing member;

inertial means for increasing an inertial force of a system which is driven by said driving motor;

connecting means for disconnectably connecting between said drive transmitting means and said inertial means;

detecting means for detecting abnormal rotation of said driving motor; and stopping means for stopping said driving motor by receiving a signal in response to the detection of the abnormal rotation, wherein when said connecting means is operated, said stopping means ignores the signal.

2. The apparatus according to claim 1, wherein said drive transmitting means comprises a gear train.

3. The apparatus according to claim 1, wherein said inertial means comprises a flywheel.

* * * * *

UNITED STATES PATENT AND TRADEMARK OFFICE

CERTIFICATE OF CORRECTION

PATENT NO. : 7,167,659 B2
APPLICATION NO. : 11/483724
DATED : January 23, 2007
INVENTOR(S) : Takashi Fujita et al.

It is certified that error appears in the above-identified patent and that said Letters Patent is hereby corrected as shown below:

SHEET NO. 9 of 18:
Figure 9, “SMOLLISH” should read --SMALLISH--.

COLUMN 1:
Line 31, “has” should read --have--.
Line 65, “clutch” should read --clutch that--.

COLUMN 2:
Line 20, “on” should be deleted.
Lne 24, “thermistors” should read --thermistor--.

COLUMN 5:
Line 2, “document” should read --document D--.

COLUMN 6:
Line 17, “on” should be deleted.
Line 21, “thermistors” should read --thermistor--.

COLUMN 8:
Line 25, “The” should read --the--.
Line 54, “y corrector” should read --γ connector--.
Line 55, “y corrector” should read --γ connector--.

COLUMN 9:
Line 56, “disk.404.” should read --disk 404.--.
Line 60, “processing,” should read --processes,--.
Line 67, “readout” should read --read out--.

COLUMN 10:
Line 42, “readout” should read --read out--.

COLUMN 11:
Line 58, “controller” should read --controllers--.

UNITED STATES PATENT AND TRADEMARK OFFICE

CERTIFICATE OF CORRECTION

PATENT NO. : 7,167,659 B2
APPLICATION NO. : 11/483724
DATED : January 23, 2007
INVENTOR(S) : Takashi Fujita et al.

It is certified that error appears in the above-identified patent and that said Letters Patent is hereby corrected as shown below:

COLUMN 13:
Line 32, "to" should read --into--.
Line 46, "revolution" should read --revolutions--.

Signed and Sealed this

Thirty-first Day of July, 2007

JON W. DUDAS
*Director of the United States Patent and Trademark Office*